US011020965B2

(12) United States Patent
Kobayashi et al.

(10) Patent No.: US 11,020,965 B2
(45) Date of Patent: Jun. 1, 2021

(54) PRINTING APPARATUS AND PRINT HEAD HEATING METHOD

(71) Applicant: CANON KABUSHIKI KAISHA, Tokyo (JP)

(72) Inventors: Daisuke Kobayashi, Kawasaki (JP); Kenichi Oonuki, Nishitokyo (JP); Satoshi Seki, Kawasaki (JP); Tsukasa Doi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 5 days.

(21) Appl. No.: 16/575,172

(22) Filed: Sep. 18, 2019

(65) Prior Publication Data

US 2020/0101724 A1 Apr. 2, 2020

(30) Foreign Application Priority Data

Sep. 28, 2018 (JP) ..... JP2018-184615

(51) Int. Cl.
*B41J 2/045* (2006.01)

(52) U.S. Cl.
CPC ..... *B41J 2/04563* (2013.01); *B41J 2/0458* (2013.01)

(58) Field of Classification Search
CPC .... B41J 2/04563; B41J 2/0458; B41J 2/0457; B41J 2/04528
See application file for complete search history.

(56) References Cited

U.S. PATENT DOCUMENTS

2017/0334226 A1* 11/2017 Lida ..... B41J 23/00

FOREIGN PATENT DOCUMENTS

JP 2000-108328 A 4/2000

* cited by examiner

*Primary Examiner* — Bradley W Thies
(74) *Attorney, Agent, or Firm* — Canon U.S.A., Inc. I.P. Division

(57) ABSTRACT

Ink in a print head is heated to a target temperature by driving heating elements included in a print head. After heating control is completed, operation that is performed using power stored in a power storage unit is started. The target temperature in the heating control is determined in such a manner that the temperature of the print head when the operation is started is a set temperature or higher.

13 Claims, 10 Drawing Sheets

PRINTING APPARATUS AND PRINT HEAD HEATING METHOD

BACKGROUND

Field

The present disclosure relates to a printing apparatus that drives a print head using power in a power storage unit and relates to a print head heating method.

Description of the Related Art

Since a motor in printing apparatuses frequently switches between driven and stopped states, printing apparatuses use current having the maximum value larger than the maximum value of current with which electronic devices that consume the same level of power. US2017/0334226 discloses an inkjet printing apparatus that utilizes a power storage element so that the apparatus operates even when power supplied from a power supply unit is small. After execution of a sequence operation, the inkjet printing apparatus stores power needed for executing the next sequence operation in the power storage element, and then starts the next sequence operation. Time needed for raising voltage across the power storage element is secured, whereby shortage of power supplied from an external power supply can be also solved during operation to be performed thereafter.

In addition, it is known that ink discharge performance of the inkjet-type printing apparatus can be maintained by heating a print head. Japanese Patent Application Laid-Open No. 2000-108328 discloses heating a print head by supplying a print head with a driving pulse having a small pulse width to the extent no bubbles are generated in ink.

SUMMARY

When a heating element is used for heating in the same manner as in Japanese Patent Application Laid-Open No. 2000-108328 in printing apparatuses that include a power storage unit such as the one disclosed in US2017/0334226, there is the following concern. That is, when power supplied to the power storage unit is small, there is a concern that it takes time to store power needed for the next operation in the power storage unit after heating a print head, and the temperature of the print head warmed by the heating decreases to a temperature that is no longer suitable for the next operation.

In consideration of the foregoing, the present disclosure has been made to solve the above inconvenience and features a technique for utilizing stored power to heat a print head and causing the print head to have a temperature suitable for operation when the operation is started after the heating.

According to an aspect of the present disclosure, a printing apparatus includes a print head including an ink discharge port and a heating element for heating the print head to heat ink contained in the print head, a power storage unit configured to store therein electric charge supplied from an external power supply, a power detection unit configured to detect power supplied from the external power supply, a temperature detection unit configured to detect a temperature of the print head, a heating control unit configured to control, as heating control, heating of the heating element to heat the print head by driving the heating element using electric charge stored in the power storage unit, based on a detection result by the temperature detection unit, an execution unit configured to execute a predetermined operation using the print head and using electric charge stored in the power storage unit after the heating control is completed, and a temperature determination unit configured to determine a target temperature, the target temperature being a temperature to which the heating element is driven to heat the print head in the heating control to bring a temperature of the print head to a set predetermined temperature or higher when the predetermined operation starts, in accordance with the supplied power detected by the power detection unit and with the set temperature.

Further features of the present disclosure will become apparent from the following description of exemplary embodiments with reference to the attached drawings.

DESCRIPTION OF THE EMBODIMENTS

<Entire Configuration>

Figure 1:
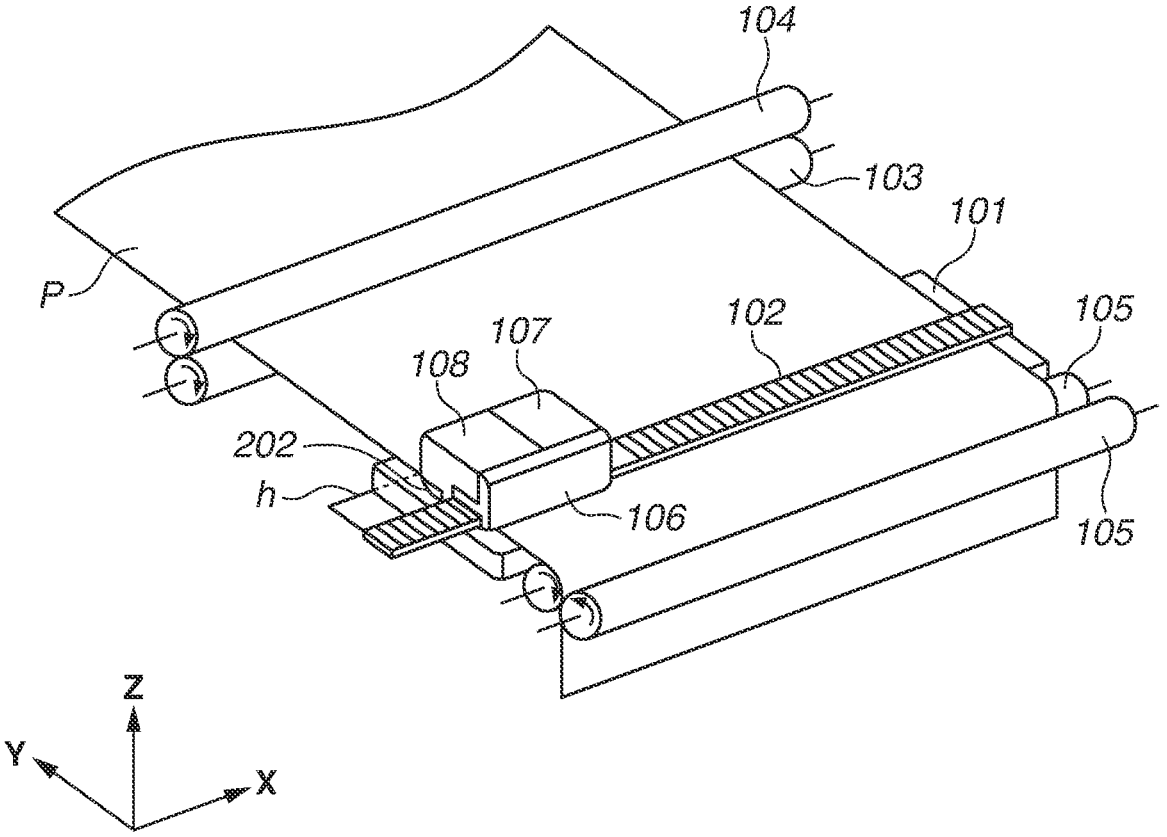
FIG. 1 is a diagram illustrating an apparatus configuration of a printing apparatus according to a first exemplary embodiment.

FIG. 1 is a schematic perspective view of an inkjet printing apparatus 300 (hereinafter printing apparatus 300) in a first exemplary embodiment. In FIG. 1, inkjet print heads 107 and 108 each have a print head and an ink tank in an integrated manner. While a print head of tank-integrated type is used in the present exemplary embodiment, a print head that is detachable from an ink tank may be used instead. The first print head 107 includes ink tanks of cyan, magenta, and yellow ink, and the second print head 108 includes an ink tank of black ink. Each of the print heads 107 and 108 includes a recording chip 202 having ink discharge ports arrayed in the Y direction to perform printing by discharging the ink from the individual discharge ports. A sheet feed roller 105 rotates to feed a printing medium P and also functions to hold the printing medium P. A conveyance roller 103 rotates while pressing the printing medium P in cooperation with an auxiliary roller 104 and intermittently conveys the printing medium P in the positive Y direction.

A platen 101 supports the back surface of the printing medium P in a printing position. A carriage 106 supports the first print head 107 and the second print head 108 and moves in the X directions. The carriage 106 reciprocates in a printing area in the X directions by a carriage belt 102 which is driven by a carriage motor (not illustrated) when printing is executed on a printing medium. The position and the speed of the carriage 106 are detected by an encoder sensor (not illustrated) mounted on the carriage 106 and an encoder scale (not illustrated) stretched across the printing apparatus. The movement of the carriage 106 is controlled based on these position and speed. The print heads 107 and 108 discharge ink while the carriage 106 moves, to execute printing on a printing medium.

The carriage 106 is on standby at a home position h when printing is not being executed or when operation such as recovery operation for the print head is performed. A recovery unit 109 (not illustrated) is provided at the home position h. The recovery unit 109 includes a wiping mechanism that wipes out ink droplets adhering to the front surfaces (discharge port surfaces) of the discharge ports in the print heads 107 and 108 to recover the normal state of the surfaces of the discharge ports. The recovery unit 109 further includes a capping mechanism to cover the discharge ports and a suction mechanism to suction ink from the discharge ports via the capping mechanism.

<Print Head Configuration>

Figure 2A:
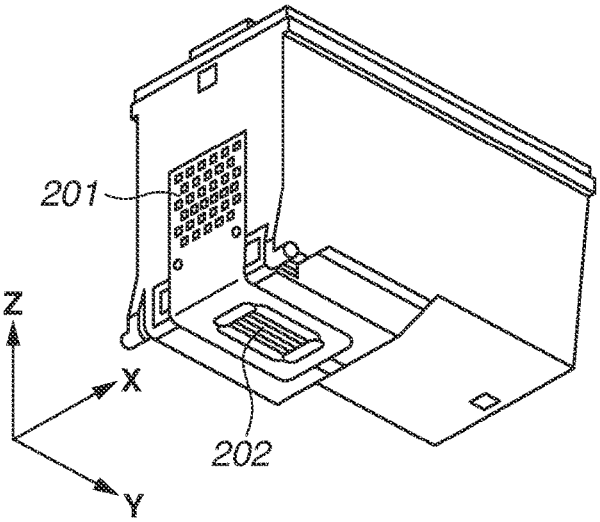
FIGS. 2A, 2B, and 2C are schematic diagrams illustrating a configuration of a print head according to the first exemplary embodiment.
Figure 2B:
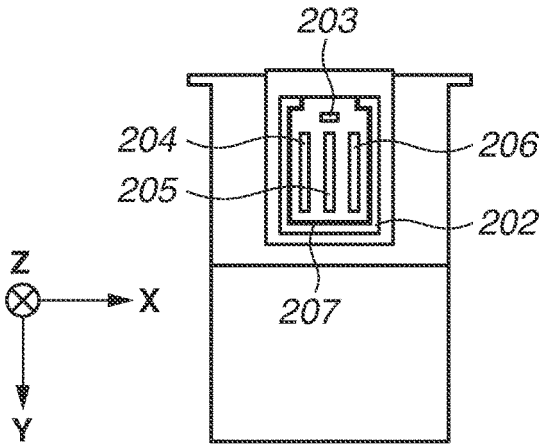
Figure 2C:
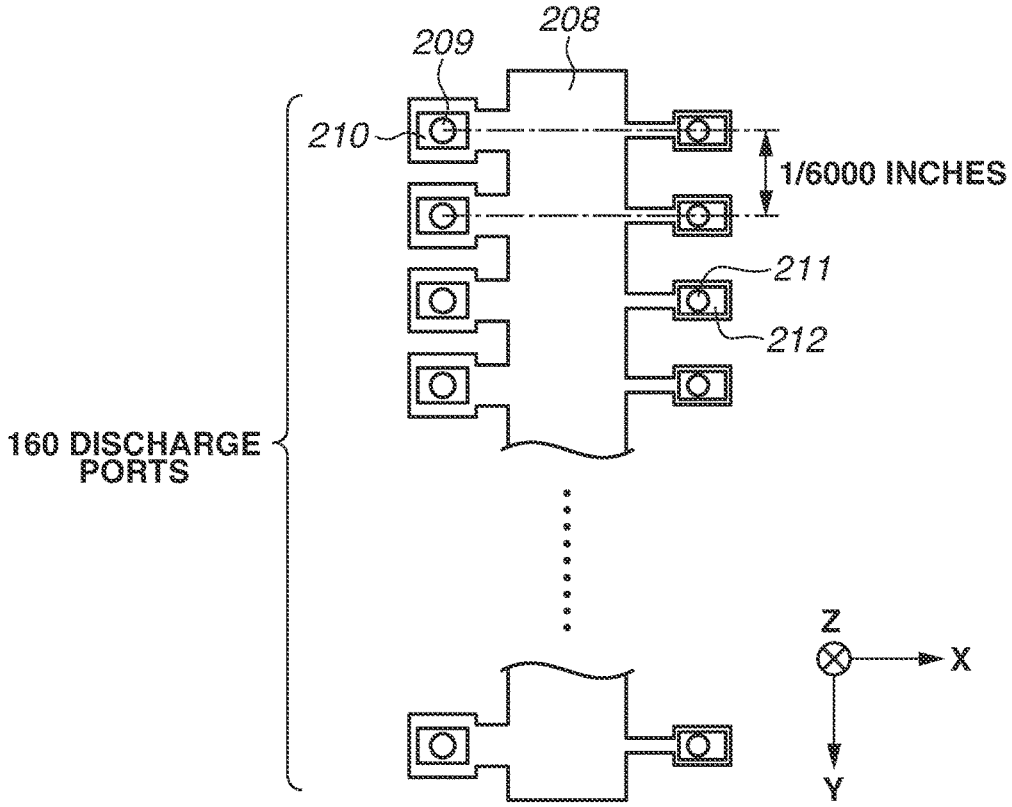

FIGS. 2A, 2B and 2C are schematic diagrams illustrating a configuration of the first print head 107 according to the present exemplary embodiment. FIG. 2A is a perspective view illustrating the first print head 107. FIG. 2B is a partially transparent schematic view illustrating the first print head 107 as viewed in the Z direction. The first print head 107 receives a print signal from the printing apparatus body via a contact pad 201, and power to drive the print head 107 is supplied thereto. The recording chip 202 includes a substrate provided with ink discharge heaters that are energy-generating elements for generating energy for discharging ink. This substrate is formed of, for example, silicon. The recording chip 202 further has thereon a diode sensor 203 to detect the temperature of the substrate and a discharge port formation member for forming a discharge port array 204 to discharge cyan ink, a discharge port array 205 to discharge magenta ink, and a discharge port array 206 to discharge yellow ink. The recording chip 202 further has thereon a sub-heater 207 for heating ink, which is a heating element disposed in a shape extensively surrounding the discharge port arrays 204, 205, and 206. This sub-heater 207 heats the substrate in the print head 107 by having voltage applied thereto, so that the substrate thus heated heats the ink. The sub-heater 207 is formed of a single metal such as aluminum or another metal or an alloy of aluminum or another metal, the resistance value of which changes depending on the temperature thereof. The sub-heater 207 may be formed of a single layer or may be formed of a plurality of layers. The sub-heater 207 does not necessarily need to surround the discharge port arrays 204, 205, and 206 in the form of a single continuous member and is formed to be able to substantially uniformly heat the entirety of the discharge port arrays 204, 205, and 206.

FIG. 2C is an enlarged view of the discharge port array 204 for cyan ink in the print head 107. Discharge ports 209 to discharge 5 pl of ink and discharge ports 211 to discharge 2 pl of ink are disposed on opposite sides of an ink chamber 208 in FIG. 2C. Immediately beneath the respective discharge ports (in the positive Z direction), 5-pl ink discharge heaters 210 and 2-pl ink discharge heaters 212 are disposed as corresponding heating elements. With voltage applied to the ink discharge heaters 210 and 212, thermal energy is generated, so that ink is discharged from the discharge ports 209 and 211. The number of the discharge ports 209 to discharge 5 pl of ink and the number of discharge ports 211 to discharge 2 pl of ink are 160. Each adjacent two of the discharge ports 209 and 211 in the Y direction have an interval of 1/600 inches therebetween, thus being configured to provide a printed pixel density of 600 dpi. Ink can be heated when drive pulses set to levels that can keep ink from being discharged are applied to the ink discharge heaters 210 and 212. Hereinafter, such heating control is referred to as short pulse heating control. In addition, the sub-heater 207 is capable of heating ink by transmitting heat to the ink via a member in the substrate in the neighborhood of the sub-heater 207.

The printing apparatus 300 according to the present exemplary embodiment adjusts the temperature of the print head substrate and the temperature of ink by performing the short pulse heating control and controlling the sub-heater 207. According to the present exemplary embodiment, heating is carried out to increase the temperature of ink near each of the discharge ports. However, the diode sensor 203 is attached to the substrate and measures the temperature of the substrate, thus not being configured to directly measure the temperature of ink. When ink is heated, the substrate is also heated, ink in the print head 107 and the substrate are brought to temperatures of substantially the same value. Therefore, in the present exemplary embodiment, the temperature of the substrate serves as a head temperature. Between the short pulse heating control and sub-heater heating control in the present exemplary embodiment, the amount of thermal energy generated per unit of time is larger in the short pulse heating control. Therefore, the short pulse heating control increases the temperature of the print head 107 faster. Meanwhile, while printing is being executed, the ink discharge heaters 210 and 212 are being used for discharging ink and are not used for short pulse heating control. Given this point, according to the present exemplary embodiment, the sub-heater heating control is executed when the temperature of ink is heated to a target temperature during printing, and the short pulse heating control is executed when the temperature of ink is heated to a target temperature not during printing.

The head temperature is adjusted through the sub-heater heating control and the short pulse heating control in such a manner that feedback control is performed by switching the print head substrate state between heated and not-heated so that a temperature based on a detection value acquired from the diode sensor 203 described later can be closer to a target temperature. The same is applied to the second print head 108, which is not illustrated.

<Power-Feed Configuration for Power Supply>

Figure 3:
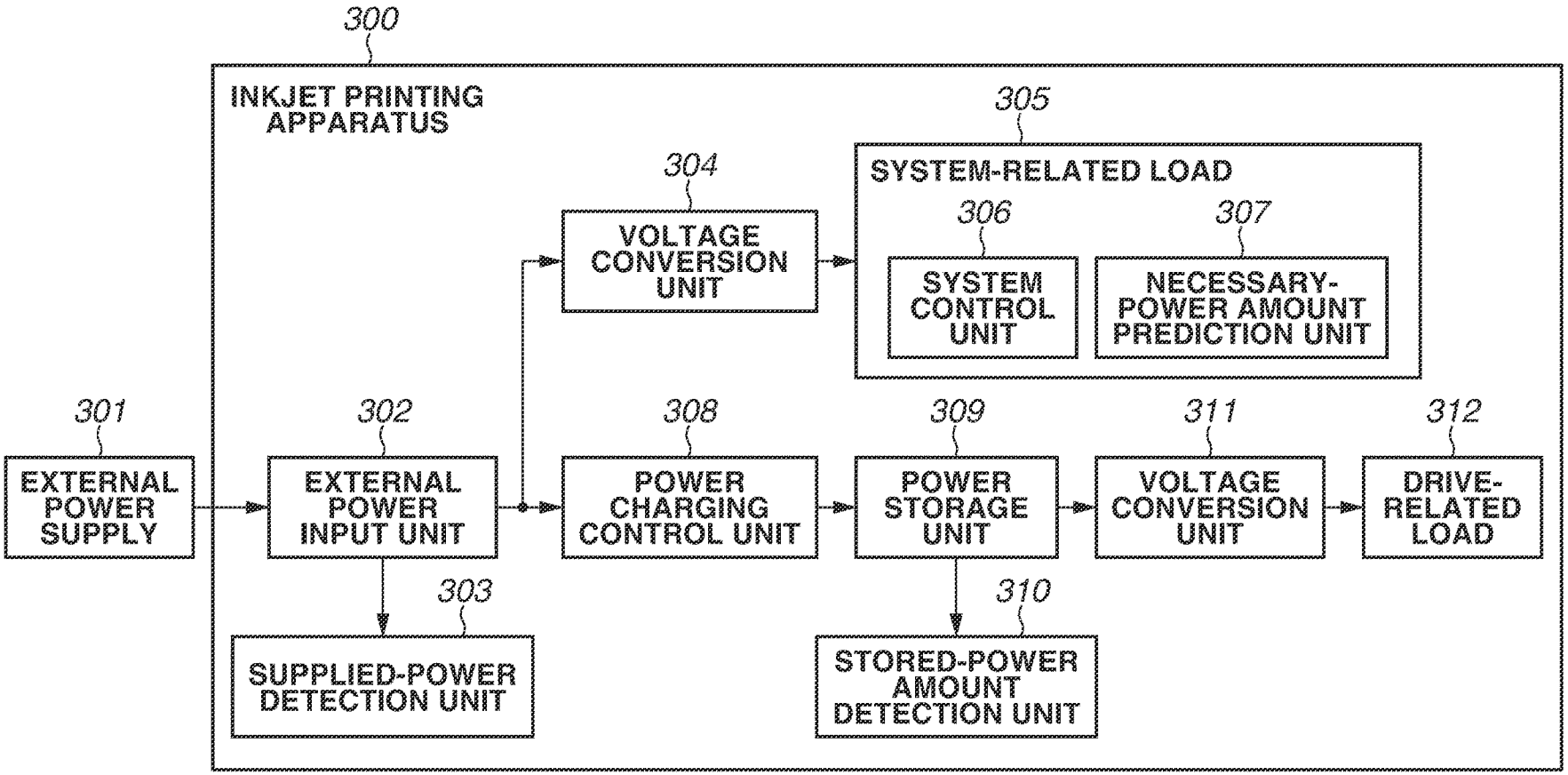
FIG. 3 is a block diagram illustrating a power supply control configuration of the printing apparatus according to the first exemplary embodiment.

FIG. 3 is a block diagram illustrating a power-feed configuration for a power supply of the printing apparatus 300 according to the present exemplary embodiment. An external power supply 301 according to the present exemplary embodiment is, for example, a personal computer (PC) provided with a (universal serial bus) USB port. The external power supply 301 may be a PC that corresponds to USB 2.0 and USB 3.0. Alternatively, the external power supply 301 may be a PC or a capacitor that corresponds to a power storage standard for USBs such as the Battery Charging Specification or to a large power feeding capability such as USB Power Delivery. Further alternatively, the external power supply 301 may be a device, such as an AC adapter, that is not provided with a USB interface.

An external power input unit 302 is a connector for providing connection to the external power supply 301.

A supplied-power detection unit 303 detects power supplied from the external power supply 301 to the external power input unit 302. Power that can be supplied from the external power input unit 302 is thus detected. Desirably, this detection of the power that can be supplied is automatically performed upon connection to the external power supply 301. For example, the external power input unit 302 that has a shape corresponding to a USB standard can determine the standard by using a USB communication cable. Alternatively, a dedicated connector may be utilized for the external power input unit 302, so that the determination is made through a communication or the like that has been uniquely arranged with the external power supply 301. Because a voltage drop occurs due to a resistance component such as a connector or a cable that connects together the external power supply 301 and the external power input unit 302, it is more desirable to measure power that can be actually supplied, than to determine power that can be logically supplied. Power actually supplied can be measured by measuring current or voltage. Thus, the external power supply 301 can be prevented from being excessively burdened by being caused to supply power that is larger than actually supplied from the external power input unit 302. According to the present exemplary embodiment, power actually supplied is detected by measuring voltage. The supplied-power detection unit 303 thus configured enables charging power to be appropriately set by a power charging control unit 308 described later in relation to various kinds of power that can be supplied that are defined by a plurality of standards.

Power acquired from the external power input unit 302 is supplied to a voltage conversion unit 304 and the power charging control unit 308. The power is converted by the voltage conversion unit 304 to have voltage with which to drive a system-related load 305 and then consumed by the system-related load 305. The system-related load 305 includes a system control unit 306 and a necessary-power amount prediction unit 307. The system control unit 306 includes a central processing unit (CPU) to perform system control of the inkjet printing apparatus 300 and a memory. The necessary-power amount prediction unit 307 is a device configured to predict the amount of power needed during execution of operation such as image printing. According to the present exemplary embodiment, the amount of power predicted by the necessary-power amount prediction unit 307 is used by the system control unit 306 to set power storage target voltage for the power storage unit 309 and to control the power storage unit 309.

The power charging control unit 308 utilizes power input from the external power input unit 302 to store power in the power storage unit 309. During this storing, power storage current with which the power charging control unit 308 stores electric charge in the power storage unit 309 is controlled so that the sum of the power storage current and the current to be consumed in the voltage conversion unit 304 can be kept from exceeding assumed tolerable current of the external power supply 301. The maximum power storage current is thus controlled. In a configuration where the supplied-power detection unit 303 refers to the communication or the standard when detecting power that can be supplied, charging power is desirably set smaller than power that can be supplied theoretically. An electric double layer capacitor is desirably used as the power storage unit 309 in consideration of its capability to speedily store and discharge power and being less prone to degradation from repeated power charging and discharging. Note that a power storage current value is determined subject to the condition that the value does not exceed current that can be supplied by the external power supply 301 described above and in consideration of other factors. Those factors include the power storage capability of the power charging control unit 308 itself and the maximum power storage current that is allowed to flow through the power storage unit 309 to provide electric charge to the power storage unit 309.

The stored-power amount detection unit 310 detects the amount of stored power in the power storage unit 309. A method for the detection is selected in accordance with the type of the power storage unit 309. For example, the method may include estimating the amount of stored electric charge by measuring the voltage across the terminals of the power storage unit 309 or may include setting up a coulomb counter by observing current input to and output from the power storage unit 309. The present exemplary embodiment is assumed to employ a method that includes detecting the voltage across the terminals of the power storage unit 309 to estimate the amount of the stored power.

The stored-power amount detection unit 310 is connected to the system control unit 306 and utilized as information to be used for performing control according to the present exemplary embodiment.

The voltage conversion unit 311 converts voltage from the power storage unit 309 into voltage necessary for the drive-related load 312. In a case where an electric double layer capacitor is used as the power storage unit 309, discharging power therefrom results in a large drop in voltage across the terminals thereof because the amount of stored electric charge and the voltage across the terminal are proportional to each other. The voltage conversion unit 311 is desirably compatible with a relatively wide range of input voltage to be able to tolerate such a voltage drop caused when the power storage unit 309 discharges power. The drive-related load 312 refers to driving of any member or members in the printing apparatus 300 from those illustrated in FIG. 1 such as the carriage belt 102, the conveyance roller 103, and the print heads 107 and 108, and the recovery unit 109. According to the present exemplary embodiment, power from the external power supply 301 is supplied to the drive-related load 312 via the power storage unit 309. However, an alternative configuration may be employed in which the drive-related load 312 is connected directly to both the power storage unit 309 and the external power supply 301, and power can be supplied to the drive-related load 312 directly from the external power supply 301. In such a case, when the external power supply 301 is one that supplies relatively small power, power is supplied to the drive-related load 312 after being temporarily stored power storage unit 309. When the external power supply 301 is one that supplies relatively large power, power supply is switched so that the external power supply 301 can directly supplies power to the drive-related load 312.

Regarding the drive-related load 312, it is assumed that whether to apply current to each of the print heads 107 and 108 and whether to cause each motor to operate or stop are controlled based on determination of the system control unit 306.

Operation to be performed by the printing apparatus 300 thus configured is described next.

Upon connection of the external power supply 301 to the external power input unit 302, power acquired from the external power input unit 302 is converted into voltage for the system-related load 305 by the voltage conversion unit 304 and then supplied to the system-related load 305. At the same time, the power other than current for the system load is stored in the power storage unit 309 by the power charging control unit 308. The stored-power amount in the power storage unit 309 is monitored by the stored-power amount detection unit 310, and the power charging control unit 308 stops power from being stored in the power storage unit 309 when the stored power reaches a predetermined value. Power stored in the power storage unit 309 is supplied to the drive-related load 312 via the voltage conversion unit 311. When the amount of stored power in the power storage unit 309 decreases to below a predetermined value as a result of operation by the drive-related load 312, power is stored by the power charging control unit 308.

<Entire Control Configuration>

Figure 4:
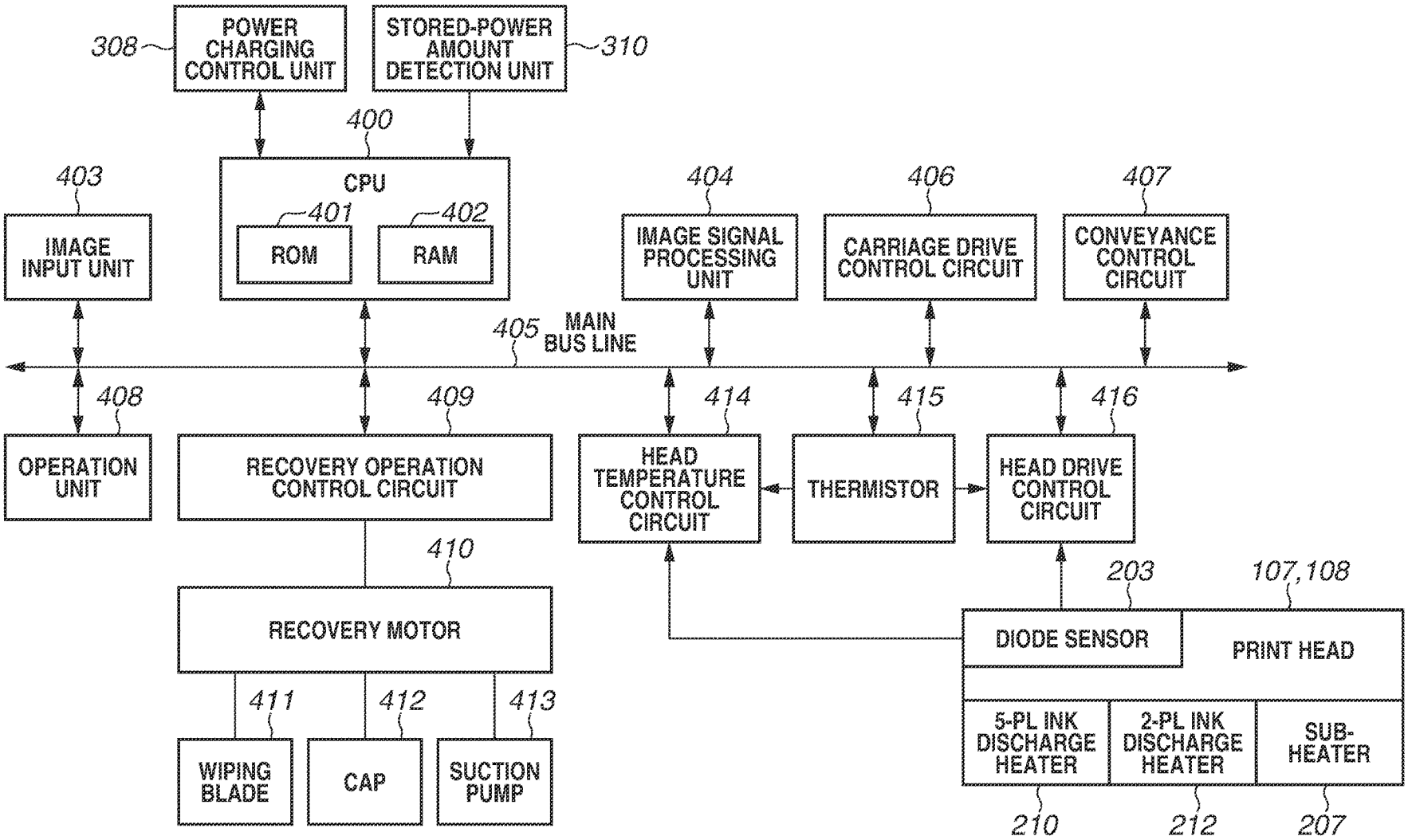
FIG. 4 is a block diagram illustrating an entire control configuration of the printing apparatus according to the first exemplary embodiment.

FIG. 4 is a block diagram illustrating the entire control configuration of the printing apparatus 300 according to the present exemplary embodiment. Constituent elements of the present control configuration are basically categorized into software-based control units and hardware-based processing units. The software-based control units correspond to the part of the system-related load 305 in FIG. 3, include processing units that individually access a main bus line 405 in FIG. 4 such as an image input unit 403, an image signal processing unit 404 that responds to the image input unit 403, and a central control unit CPU 400. The hardware-based processing units correspond to the drive-related load 312 in FIG. 3. The drive-related load 312 includes processing units illustrated in FIG. 4 such as an operation unit 408, a recovery operation control circuit 409, a head temperature control circuit 414, a head drive control circuit 416, a carriage drive control circuit 406, and a conveyance control circuit 407. The CPU 400 typically includes the ROM 401 and the RAM 402, provides appropriate printing conditions to input information, and executes printing while driving the ink discharge heaters 210 and 212 in the print heads 107 and 108. The CPU 400 controls the power charging control unit 308 based on information on the amount of stored power in the power storage unit 309 detected by the stored-power amount detection unit 310. The CPU 400 also controls the head temperature control circuit 414 (described later) based on information on the amount of stored power in the power storage unit 309 detected by the stored-power amount detection unit 310.

The ROM 401 has a computer program for executing recovery operation on a print head previously stored therein and provides recovery conditions such as a preliminary discharge condition to the recovery operation control circuit 409 and the print heads 107 and 108. A recovery motor 410 drives the print heads 107 and 108 and members that carry out recovery operation on the print heads 107 and 108, which are a wiping blade 411, a cap 412, and a suction pump 413. Based on a detection result from the diode sensor 203 that detects head temperatures, the head temperature control circuit 414 determines driving conditions to be applied to driving of the sub-heaters 207 on the print heads 107 and 108. The head drive control circuit 416 then drives the sub-heaters 207 based on the determined driving conditions.

The head drive control circuit 416 also drives the ink discharge heaters 210 and 212 on the print heads 107 and 108. This driving of these heaters 210 and 212 causes the print heads 107 and 108 to perform ink temperature adjustment for ink discharge, preliminary discharge, and temperature adjustment control. A computer program for executing the temperature adjustment control has been stored in, for example, the ROM 401 and causes operation, such as detection of the head temperatures and driving of the sub-heaters 207, to be executed via circuits such as the head temperature control circuit 414 and head drive control circuit 416. Note that the head drive control circuit 416 drives ink discharge heaters 210 and 212 by using drive signals each composed of a pre-pulse and a main pulse, and ink is discharged.

<Head Temperature Acquisition Control>

Figure 5:
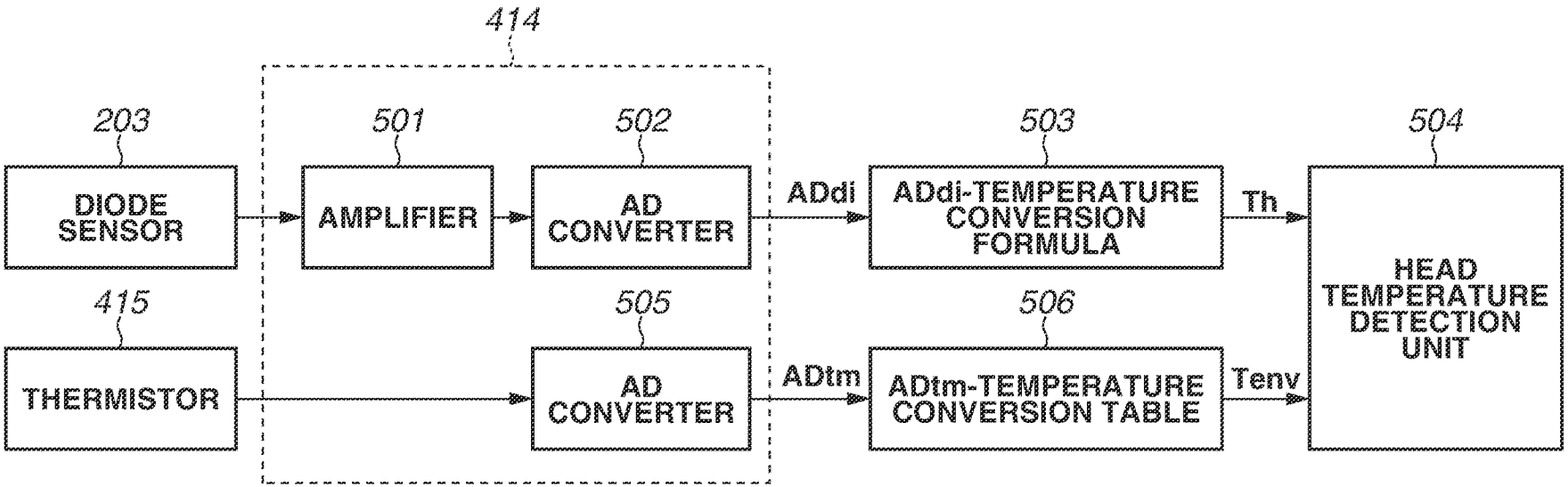
FIG. 5 is a block diagram illustrating processing procedure in a head temperature control circuit according to the first exemplary embodiment.

Print head temperature acquisition control in the present exemplary embodiment is described next. FIG. 5 is a block diagram illustrating the flow of processing in the head temperature control circuit 414 and processing to be performed on software via a read-only memory (ROM) 401 and a random access memory (RAM) 402. When voltage based on the print head temperatures is input to the head temperature control circuit 414 from the diode sensors 203 provided on the print heads 107 and 108, the amplifier 501 amplifies the values of the voltage. The amplified voltage values are then digitalized by an analog-digital (AD) converter 502. Diode sensor voltage values ADdi obtained through the digitalization are converted into diode temperatures, which are referred to as head temperatures Th herein, by use of an ADdi-temperature conversion formula 503 stored in the ROM 401. In parallel, when voltage based on the environment temperature surrounding the printing apparatus 300 is input from a thermistor 415 to the head temperature control circuit 414, the AD converter 505 digitalizes the voltage. A thermistor voltage value ADtm obtained through the digitalization is converted into a thermistor temperature Tenv by use of an ADtm-temperature conversion table 506 stored in the ROM 401. The head temperature Th and thermistor temperature Tenv thus obtained are input to the head temperature detector 504 to be used for control described later according to the present exemplary embodiment.

The flow of the print head heating process in the printing apparatus 300 configured as described above is described next. If the head temperatures Th are low when the print heads 107 and 108 are used to print an image or to perform ink discharge (preliminary discharge) that has no effect on image printing, discharging a desired amount of ink or even discharging any ink may fail. Therefore, the head temperatures are raised by heating the print heads 107 and 108 before discharge is started. The print heads 107 and 108 are heated so that the head temperatures Th when ink discharge is started can become a set temperature T1 or higher. According to the present exemplary embodiment, if the amount of stored power in the power storage unit 309 is less than power needed for ink discharge after the heating process is performed, power is stored in the power storage unit 309. Because the heating is not provided while power is being stored, the head temperatures Th decrease over the period from when the heating operation is ended to when ink discharge is started. In consideration of this point, the heating process provides heating in which a target temperature Tn that is the set temperature T1 or higher is set so that the head temperatures Th at the start of discharge can be the set temperature T1 or higher even if the head temperatures Th have decreased. The following describes heating the print heads 107 and 108 by short pulse heating. Alternatively, the head temperatures Th may be raised by heating provided by the sub-heaters 207. Heating is provided so that the head temperatures Th can reach the target temperature Tn, and the heating process is ended when the head temperature detector 504 detects that the head temperatures Th are the target temperature Tn or higher.

Figure 6:
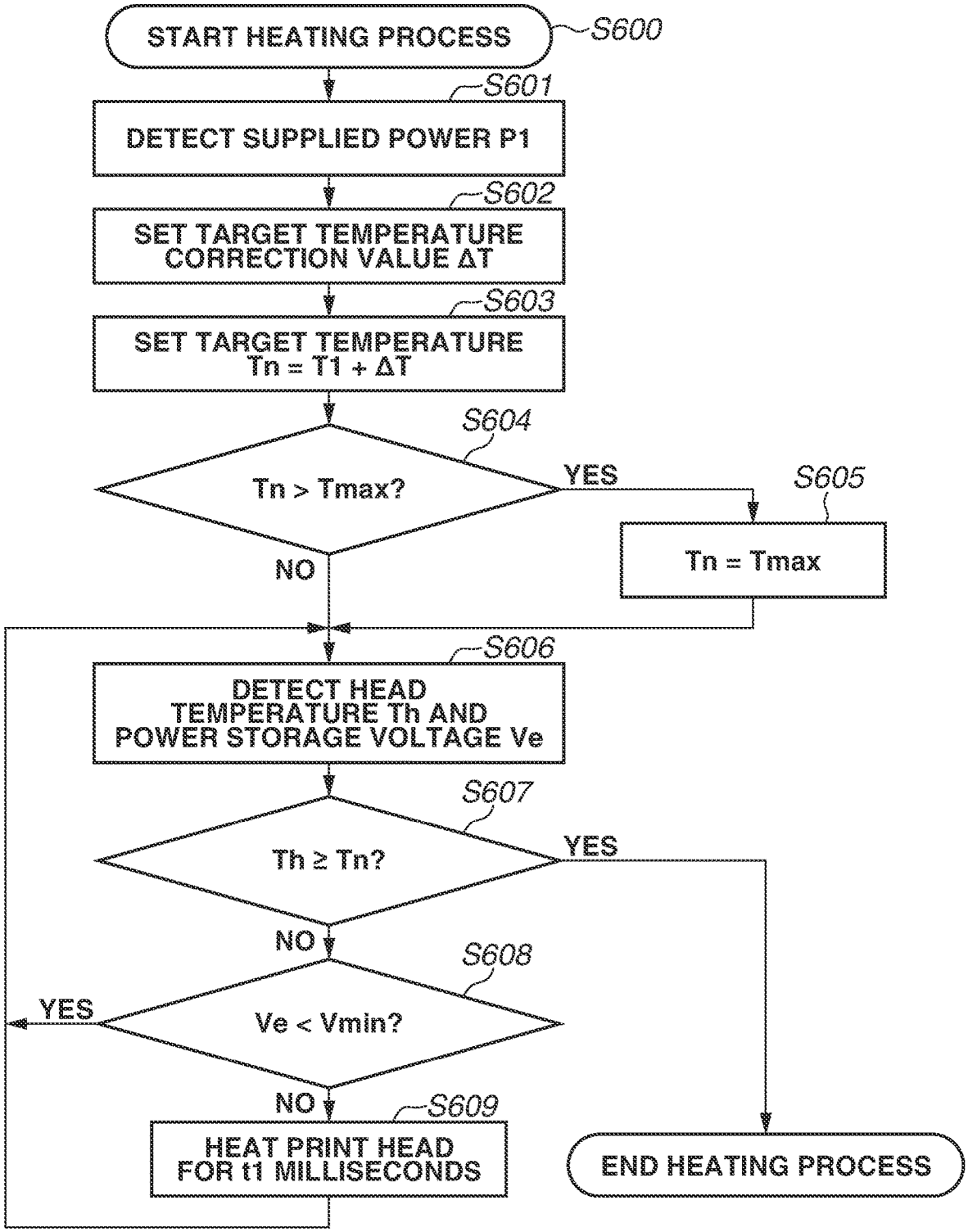
FIG. 6 is a flowchart illustrating a print head heating process according to the first exemplary embodiment.

FIG. 6 is a flowchart illustrating processing procedure of the print head heating process in the printing apparatus 300 according to the first exemplary embodiment. The heating process in step S600 and steps subsequent thereto is a process to be performed when the CPU 400 causes the head temperature control circuit 414 and the print heads 107 and 108 to operate by executing a computer program stored in the ROM 401.

In step S600, the heating process is started when the CPU 400 acknowledges a preliminary discharge instruction or a printing instruction.

Subsequently, in step S601, the supplied-power detection unit 303 detects the supplied power P1 that is being supplied from the external power supply 301 connected to the external power input unit 302.

Subsequently, in step S602, a target temperature correction value ΔT is set based on the supplied power P1 using the set temperature T1 for the print heads 107 and 108. The set temperature T1 has been set in advance and stored in the ROM 401, and is read out from the ROM 401. The target temperature correction value ΔT is set so that, even if the head temperatures Th decreases while the power charging control unit 308 stores power in the power storage unit 309 after the print heads 107 and 108 are heated, the head temperatures Th at the start discharge may be the set temperature T1 or higher. A calculation method for the target correction temperature ΔT is detailed later.

Subsequently, in step S603, the target temperature for the head temperatures is set to (T1+ΔT) and determines the temperature thus set to be the target temperature Tn in the heating process.

Subsequently, in step S604, the target temperature Tn is compared with a maximum set temperature Tmax. The maximum set temperature Tmax is the upper limit of a range of temperature that does not affect stable discharge. If the target temperature Tn is the maximum set temperature Tmax or lower, the processing proceeds to step S606. If the target temperature Tn is higher than the maximum set temperature Tmax, the value of the target temperature Tn is replaced by the value of the maximum set temperature Tmax from (T1+ΔT) in step S605, and the processing proceeds to step S606. Through Steps S604 and S605, the target temperature Tn that enables the print head 107 or 108 to be heated to as high a temperature as possible can be set even when the target temperature Tn set in step S603 is higher than a range of temperature that enables ink to be stably discharged.

In subsequent step S606, the head temperature detector 504 detects the head temperatures Th, and the stored-power amount detection unit 310 detects the power storage voltage Ve.

Subsequently, in step S607, the head temperatures Th are compared with the target temperature Tn. If the head temperatures Th are the target temperature Tn or higher, the heating is ended because the target temperature Tn or higher has been reached through the heating. If any of the head temperatures Th is lower than the target temperature Tn, the processing proceeds to step S608.

In step S608, the power storage voltage Ve is compared with the minimum power storage voltage Vmin. The minimum power storage voltage Vmin is voltage that prevents voltage from falling below operation ensuring voltage Vth, which is the lower limit of a range of voltage that does not affect stable heating when operation in subsequent step S609 is performed. If the power storage voltage Ve is less than the minimum power storage voltage Vmin, the processing returns to step S606 without heating. If the power storage voltage Ve is the minimum power storage voltage Vmin or more, the print heads 107 and 108 are heated for t1 milliseconds in step S609. The print heads 107 and 108 are heated with drive signals sent from the head drive control circuit 416 to the respective ink discharge heaters 210 and 212 of the print heads 107 and 108. The drive signals provide pulses that are short to the extent that no bubbles are generated in ink. In this manner, when the print heads 107 and 108 are heated in step S609, voltage across the power storage unit 309 is prevented from dropping to the lower limit (hereinafter referred to as operation ensuring voltage) of a range of voltage that can drive the print heads 107 and 108 or that does not affect stable operation of the entire printing apparatus 300.

After the heating in step S609, the processing proceeds to step S606, so that the heating may be repeated until the head temperatures Th become the target temperature Tn or higher.

After the completion of the heating process, power is stored until voltage across the power storage unit 309 becomes ink-discharge voltage V1, which is voltage needed for discharging ink. Ink then starts to be discharged. When the heating is ended while the power storage voltage Ve is less than the minimum power storage voltage Vmin in S608, the target temperature Tn or higher has not been reached through the heating. However, ink starts to be discharged when the ink-discharge voltage V1 or higher is reached after the completion of the heating process. The target temperature Tn is set so that the set temperature T1 may be reached in a power storage time tc. Therefore, ink discharge may be started the power storage time tc later than the completion of the heating process so that ink discharge may be started after the head temperatures reach the set temperature T1.

Next, a control method and a method for setting parameters used in steps S602, S604, S605, and S608 are described.

A target temperature correction value ΔT in step S602 is described. From the supplied power P1 detected by the supplied-power detection unit 303, the power storage time tc is predicted, which is required for the power charging control unit 308 to store necessary stored power amount in the power storage unit 309 for ink discharge after heating the print heads 107 and 108. Subsequently, a temperature decrease in the head temperature Th that is expected to occur in the next power storage time tc, and this temperature decrease is set as the target temperature correction value ΔT. The set temperature T1 herein is set to temperature at which the print heads 107 and 108 suitably discharge ink, which is 50° C. according to the present exemplary embodiment.

The power storage time tc is set to maximum possible power storage time in the present exemplary embodiment. The power storage time tc is calculated as time needed for the power storage unit 309 to store power until the ink-discharge voltage V1 needed for the ink-discharge operation after the heating is reached, by using the operation ensuring voltage Vth as the starting point. The ink-discharge voltage V1 herein is obtained by the system control unit 306 after the necessary-power amount prediction unit 307 predicts a power consumption amount needed for operation to be performed after the heating. The power storage time tc is independent of the power storage voltage Ve and is found by a formula tc=(V1−Vth)/Q1 on the assumption that the supplied power P1 is stored at substantially constant power storage speed Q1. For the power storage speed Q1, the power storage speeds Q1 that correspond to various values of the supplied power P1 have been previously stored in the ROM 401. In the above-described manner, the power storage time tc that corresponds to a particular value of the supplied power P1 can be obtained.

Figure 7:
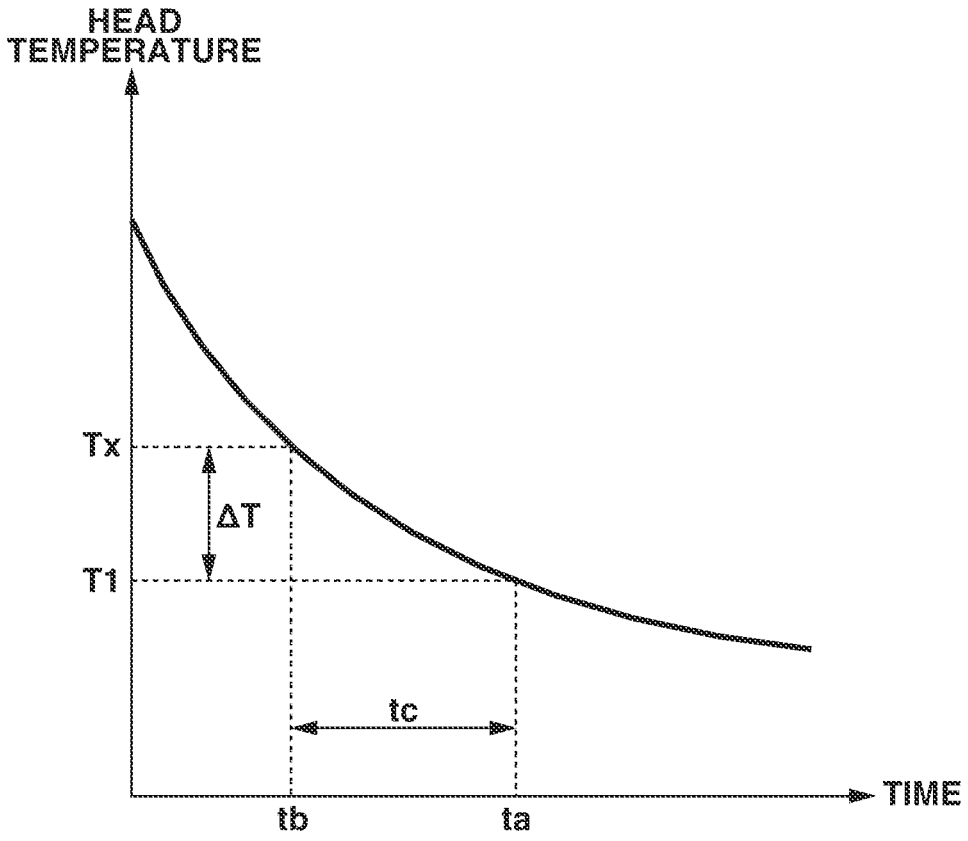
FIG. 7 is a diagram illustrating a relation between an elapsed time and a head temperature in a case where a temperature of the print head is decreased from a predetermined temperature and the relation thereof with control parameters according to the first exemplary embodiment.

The target temperature correction value ΔT can be obtained using the power storage time tc and a temperature decrease curve based on measured head temperatures. The relation between the time and the head temperature Th in the temperature decrease curve has been stored in the ROM 401 in the form of an approximation formula or a table. FIG. 7 illustrates a graph of a temperature decrease curve. The graph depicts the relation between the elapsed time and the head temperature Th and the relation thereof with control parameters according to the present exemplary embodiment in a case where the temperature of the print head 107 or 108 is decreased from a certain temperature. As illustrated in FIG. 7, the target temperature correction value ΔT is obtained by finding the difference (Tx−T1) of the set temperature T1 with a temperature Tx at a time point tb that is at least the power storage time tc earlier than a time point ta at which the set temperature T1 is reached.

An alternative method for setting the target temperature correction value ΔT may be employed in which, while a table or the like that prescribes the target temperature correction value ΔT in association with the supplied power P1 and the set temperature T1 has been stored in advance in the ROM 401, the target temperature correction value ΔT is read out onto the RAM 402 as appropriate to be set.

In steps S604 and S605, the maximum set temperature Tmax is desirably set to a value (Tth−Ta) obtained by subtracting a temperature Tth from a temperature increase Ta that is expected to occur to the print head 107 or 108 through the heating in step S609. The temperature Tth is the upper limit of a range of temperature that can ensure that the print head 107 or 108 can operate. Thus, the head temperature Th can be prevented from exceeding Tth even when the print head 107 or 108 has been heated in step S609.

In step S608, the minimum power storage voltage Vmin is desirably set to a value (Vth+Va) obtained by adding a voltage drop Va to the operation ensuring voltage Vth. The voltage drop Va is a voltage drop expected to occur to the power storage unit 309 through the heating of the print head 107 or 108 in step S609. Thus, the power storage voltage Ve can be prevented from falling below the operation ensuring voltage Vth even when the print head 107 or 108 has been heated in step S609.

Upon completion of the heating when the heating process is ended, the power storage unit 309 has stored therein power needed for the ink-discharge operation, and the ink-discharge operation is started.

In a case where the target temperature Tn is set to the maximum set temperature Tmax in step S605, the head temperature Th is lower than the set temperature T1 at the start of the ink-discharge operation. Although the ink-discharge operation is started even if the head temperature Th is lower than the set temperature T1 at the start of the ink-discharge operation in the present exemplary embodiment, the ink-discharge operation may be started after the print head 107 or 108 is heated again to the set temperature T1 before the start of the ink-discharge operation.

Alternatively, the target temperature correction value ΔT may be calculated with consideration given to the environment temperature. For example, the relation between the time and the temperature in the temperature decrease curve for the print head 107 or 108 has been stored in the ROM 401 in the form of an approximation formula or a table with respect to each value of the environment temperature Tenv. The target temperature correction value ΔT that corresponds to the environment temperature Tenv can be obtained using, in step S602, the approximation formula or the table that corresponds to the environment temperature Tenv after the head temperature detector 504 detects the environment temperature Tenv in step S601. Thus, the target temperature correction value ΔT can be obtained with higher accuracy.

Figure 8:
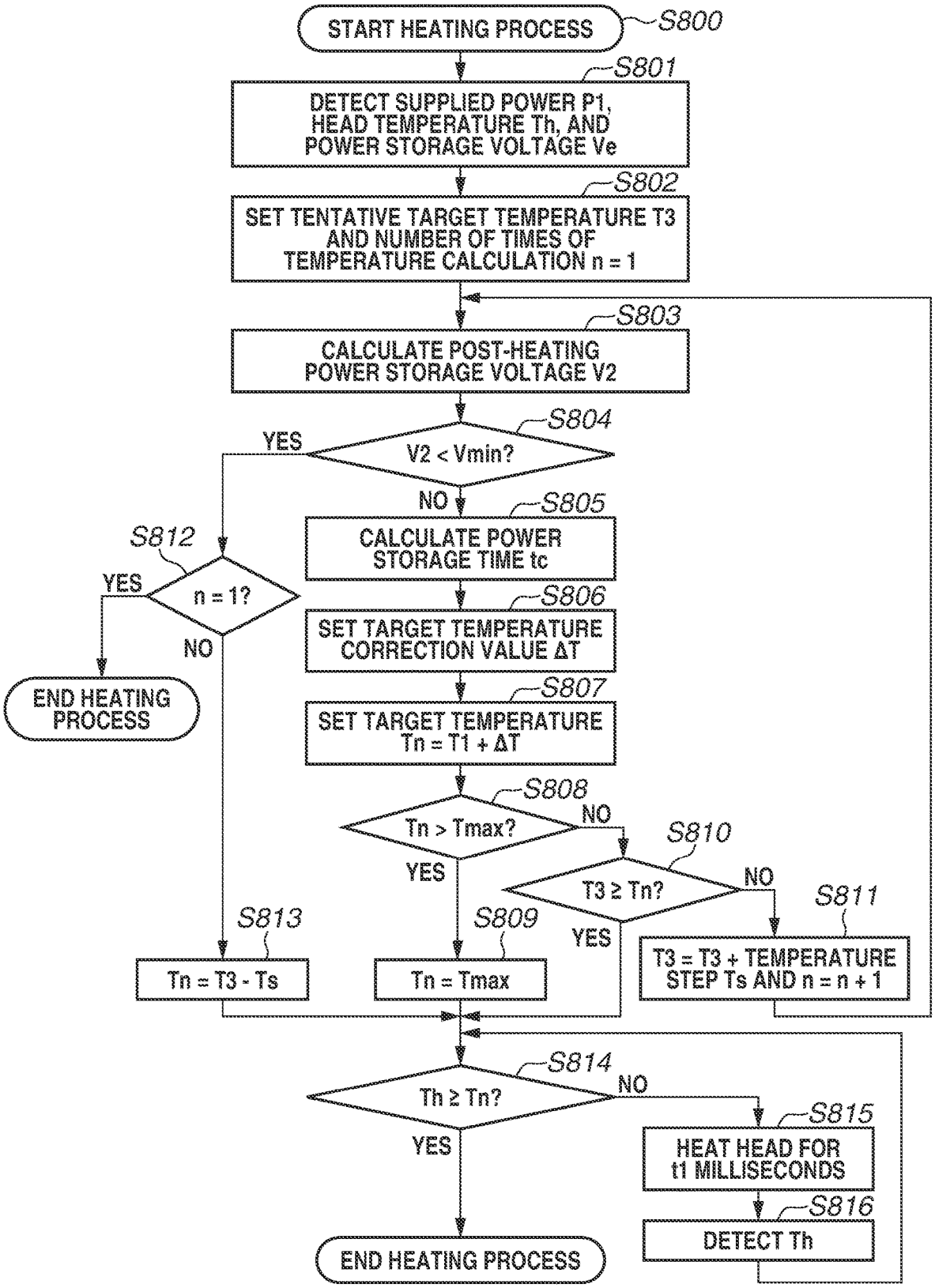
FIG. 8 is a flowchart illustrating a print head heating process according to a second exemplary embodiment.

In the first exemplary embodiment, the target temperature Tn for the print heads 107 and 108 is corrected assuming that voltage at the start of power storage when the power charging control unit 308 stores power in the power storage unit 309 after the print head heating is the operation ensuring voltage Vth that is a fixed value. In a second exemplary embodiment, the target temperature Tn is corrected further based on the result of measurement of voltage at the start of the power storage. FIG. 8 illustrates a flowchart for a heating process in the second exemplary embodiment. Elements different from those in the first exemplary embodiment are mainly described, and descriptions of the identical elements are omitted.

In step S800, the heating process is started when the CPU 400 receives the preliminary discharge instruction or the printing instruction in the same manner as in step S600.

Subsequently, in step S801, the supplied-power detection unit 303 detects the supplied power P1 that is being supplied from the external power supply 301 connected to the external power input unit 302. In addition, the head temperature detector 504 detects the head temperatures Th, and the stored-power amount detection unit 310 detects the power storage voltage Ve of the power storage unit 309.

Subsequently, in step S802, a tentative target temperature T3 is set, and the number n of times that temperature calculation is attempted is set to 1. The tentative target temperature T3 is the set temperature T1 or higher and has been previously set to a certain desirable value.

Subsequently, in step S803, post-heating power storage voltage V2, which is power storage voltage after the print head 107 or 108 is heated from the head temperature Th to the target temperature T3, is calculated using the supplied power P1, the head temperature Th, the power storage voltage Ve, and the tentative target temperature T3. A method for obtaining the post-heating power storage voltage V2 is described later.

If the post-heating power storage voltage V2 is the minimum power storage voltage Vmin or more in step S804 subsequently, the processing proceeds to step S805. If the post-heating power storage voltage V2 is less than the minimum power storage voltage Vmin, the processing proceeds to step S812. The processing in step S812 and steps subsequent thereto is described later.

In step S805, based on the supplied power P1, the power storage time tc needed for the power charging control unit 308 to store power while causing the voltage across the power storage unit 309 to reach V1 from V2 after the head temperature Th is heated to T3 is found using the post-heating power storage voltage V2 and the ink-discharge voltage V1. The power storage time tc is found using the formula tc=(V1−Vth)/Q1 with the post-heating power storage voltage V2 used in place of the operation ensuring voltage Vth used in step S602 in the first exemplary embodiment.

Subsequently, in step S806, the target temperature correction value ΔT is found using the set temperature T1, the power storage time tc, and the approximation formula or the table in the same manner as in step S602 in the first exemplary embodiment. First of all, to bring a temperature at the start of ink discharge to the set temperature T1 when the power storage time tc is needed, the temperature Tx needed when the heating process is ended is found. Subsequently, the target temperature correction value ΔT is found using the formula ΔT=Tx−T1, and the target temperature Tn is set to (T1+ΔT) in step S807.

Subsequently, in step S808, the target temperature Tn is compared with a maximum set temperature Tmax in the same manner as in step S604. If the target temperature Tn is higher than the maximum set temperature Tmax, the value of the target temperature Tn is replaced by the value of the maximum set temperature Tmax from (T1+ΔT) in step S809, and the processing proceeds to step S814. If the target temperature Tn is the maximum set temperature Tmax or lower, the processing proceeds to step S810. Through the above processing, the target temperature Tn can be set to a temperature that enables the print head 107 or 108 to be heated to as high a temperature as possible that enables stable discharge of the print head 107 or 108 even when the target temperature Tn set in step S807 is higher than a range of temperature that enables ink to be stably discharged.

If the processing has proceeded to step S810, the tentative target temperature T3 is compared with the target temperature Tn in step S810. If the tentative target temperature T3 is the target temperature Tn or higher, the head temperature can be maintained at the set temperature T1 or higher even after the power charging control unit 308 stores power in the power storage unit 309 after the heating. The heating is then started in step S814. In contrast, if the tentative target temperature T3 is lower than the target temperature Tn, the processing proceeds to step S811. In step S811, a temperature step Ts is added to the tentative target temperature T3, and the tentative target temperature is updated to (T3+Ts), which is followed by increment of n by 1. The processing then returns to step S803. The temperature step STs is an interval of temperature at which a temperature desired to be detected is measured and is set to a predetermined value in advance.

If the processing has proceeded to step S814, the head temperature Th is compared with the target temperature Tn. If the head temperature Th is the target temperature Tn or higher, it means that sufficient heating has been provided, and the heating process is therefore ended. If the head temperature Th is lower than the target temperature Tn, the processing proceeds to step S815. In step S815, the print heads 107 and 108 are heated for t1 milliseconds in the same manner as in step S609 in the first exemplary embodiment. Thereafter, the head temperature detector 504 detects the head temperature Th in step S816, and the processing returns to S814. Steps S814 to S816 are repeated until the head temperature Th reaches the target temperature Tn or higher.

After the completion of the heating process, power is stored until voltage across the power storage unit 309 becomes the ink-discharge voltage V1, which is voltage needed for discharging ink. Ink then starts to be discharged.

In step S804, if the post-heating power storage voltage V2 is less than the minimum power storage voltage Vmin, it is determined in step S812 whether n is 1. If n is 1, it means that heating to the tentative target temperature T3 that has been set for the first time after the start of the heating process is impossible with the power storage voltage Ve of the power storage unit 309 detected in step S803. The heating process is therefore ended. If n is greater than 1, the processing proceeds to S813. For example, if n is 3, heating to the tentative target temperature T3 that has been set with n=3 is impossible because the post-heating power storage voltage V2 exceeds the minimum power storage voltage Vmin. However, heating to the tentative target temperature T3 that has been set with n=2 is possible without having the post-heating power storage voltage V2 exceeding the minimum power storage voltage Vmin. Therefore, in step S813, the target temperature Tn is set to the tentative target temperature (T3−Ts) with n=3, that is, the tentative target temperature T3 with n=2, and the heating is started in step S814. The processing in step S804 can prevent the voltage across the power storage unit 309 from falling below the operation ensuring voltage Vth when the print heads 107 and 108 are heated after step S814.

An example of the method for obtaining the post-heating power storage voltage V2 in step S803 is described. First of all, time th needed for heating the print heads 107 and 108 from the head temperature Th to the tentative target temperature T3 is found while power needed for heating the print heads 107 and 108 is denoted as P2. It can be simply considered that the time th needed for the heating is proportional to the difference between the temperatures and inversely proportional to the power. Based on this consideration, the time th needed for the heating can be found using the formula th=A×(T3−Th)/P2. The term "A" here is a constant, the value of which can be experimentally obtained. Subsequently, a voltage drop ΔV in the power storage unit 309 as a result of heating of the print heads 107 and 108 for the time th with the power P2 is found using the supplied power P1, the power P2, and the time th. It can be simply considered that the voltage drop ΔV is proportional to the product of consumed power and the time th. Based on this consideration, the voltage drop ΔV can be found using the formula ΔV=B×(P2−P1)×th. The term "B" here is a constant, the value of which can be experimentally obtained. The post-heating power storage voltage V2 can be obtained using the formula V2=Ve−ΔV with the power P2, the constant A, and the constant B stored in the ROM 401 or the RAM 402 and used as appropriate.

Figure 9:
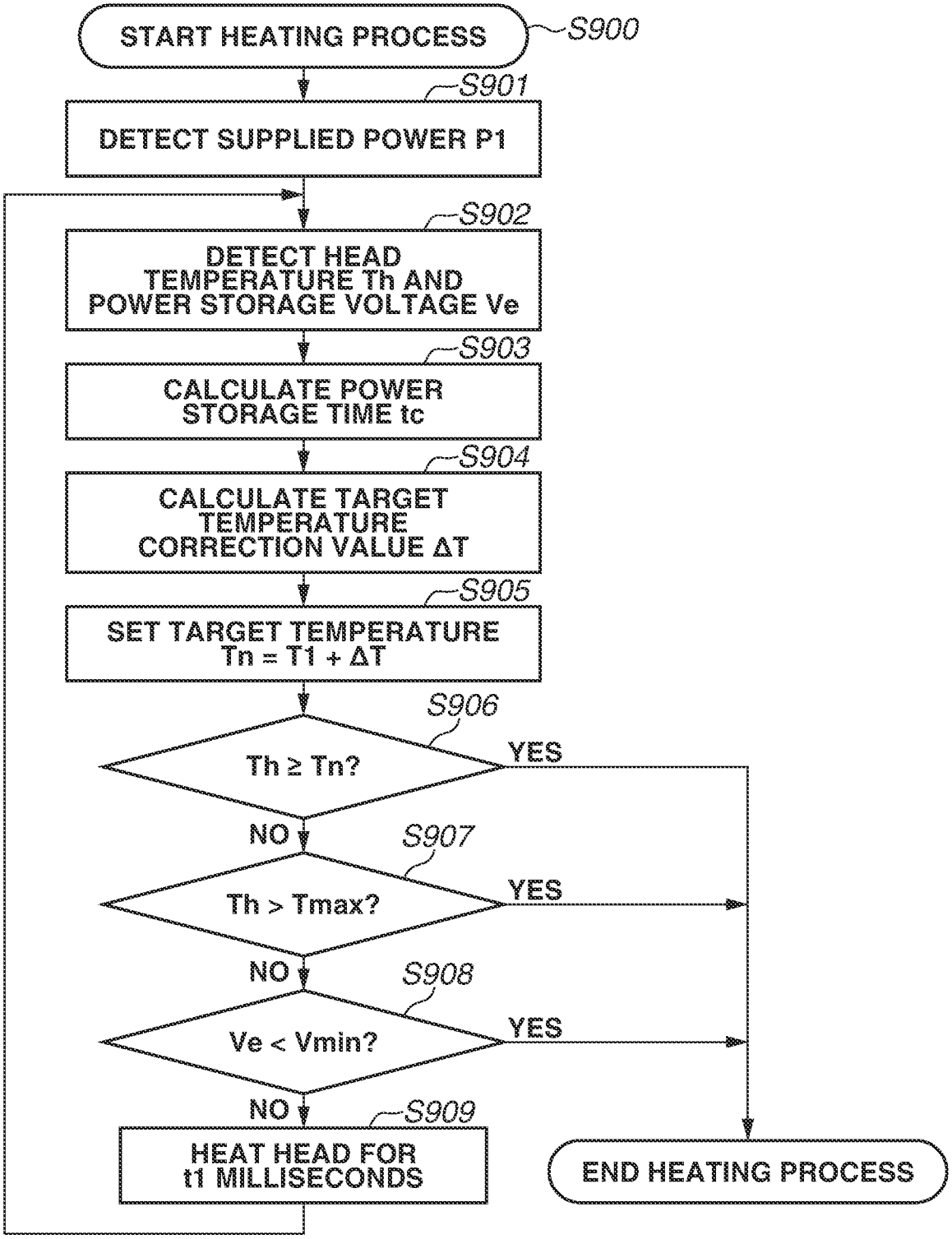
FIG. 9 is a flowchart illustrating a print head heating process according to a third exemplary embodiment.

The first and second exemplary embodiments illustrate methods in which the target temperature Tn is corrected and set prior to heating the print heads 107 and 108. A third exemplary embodiment illustrates processing in which, while the print heads are heated, the target temperature Tn is successively corrected and set in accordance with voltage of the corresponding time point across the power storage unit 309. FIG. 9 is a flowchart illustrating a heating process according to the third exemplary embodiment. Elements different from those of the first and second exemplary embodiments are mainly described, and descriptions of the identical elements are omitted.

In step S900, the heating process is started when the CPU 400 receives the preliminary discharge instruction or the printing instruction in the same manner as in step S600 in the first exemplary embodiment.

Subsequently, in step S901, the supplied-power detection unit 303 detects the supplied power P1 that is being supplied from the external power supply 301 connected to the external power input unit 302.

Subsequently, in step S902, the head temperature detector 504 detects the head temperatures Th, and the stored-power amount detection unit 310 detects the power storage voltage Ve of the power storage unit 309.

In step S903, the power storage time tc needed for the power charging control unit 308 to store power while increasing the voltage across the power storage unit 309 from Ve to V1 is found using the supplied power P1, the power storage voltage Ve, and the ink-discharge voltage V1. The power storage time tc is found using the formula tc=(V1−Vth)/Q1 with the power storage voltage Ve used in place of the operation ensuring voltage Vth used in step S602 in the first exemplary embodiment.

Subsequently, the same processing as is performed in steps S602 and S603 in the first exemplary embodiment is performed in steps S904 and S905. The same processing as is performed in step S607 in the first exemplary embodiment is performed in subsequent step S906.

Subsequently, in step S907, the head temperatures Th are compared with the maximum set temperature Tmax. If the head temperature Th is the maximum set temperature Tmax or higher, the heating process is ended. If the head temperature Th is lower than the maximum set temperature Tmax, the processing proceeds to step S908.

Subsequently, the same processing as is performed in steps S608 and S609 in the first exemplary embodiment is performed in steps S908 and S909. The power storage voltage Ve is compared with the minimum power storage voltage Vmin in step S908. If the power storage voltage Ve is less than the minimum power storage voltage Vmin, the heating is ended. If the power storage voltage Ve is the minimum power storage voltage Vmin or more, the print heads 107 and 108 are heated for t1 milliseconds in step S909. After the print heads 107 and 108 are heated in S909, the processing returns to step S902.

After the completion of the heating process, power is stored until voltage across the power storage unit 309 becomes the ink-discharge voltage V1, which is voltage needed for discharging ink. Ink then starts to be discharged.

Figure 10A:
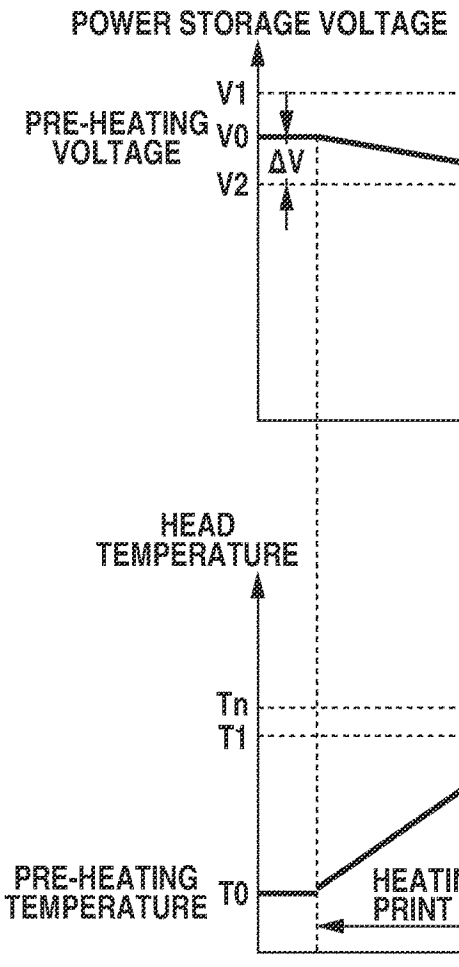
FIGS. 10A and 10B are diagrams each illustrating changes in temperature and in stored-power amount according to the first to third exemplary embodiments.
Figure 10B:
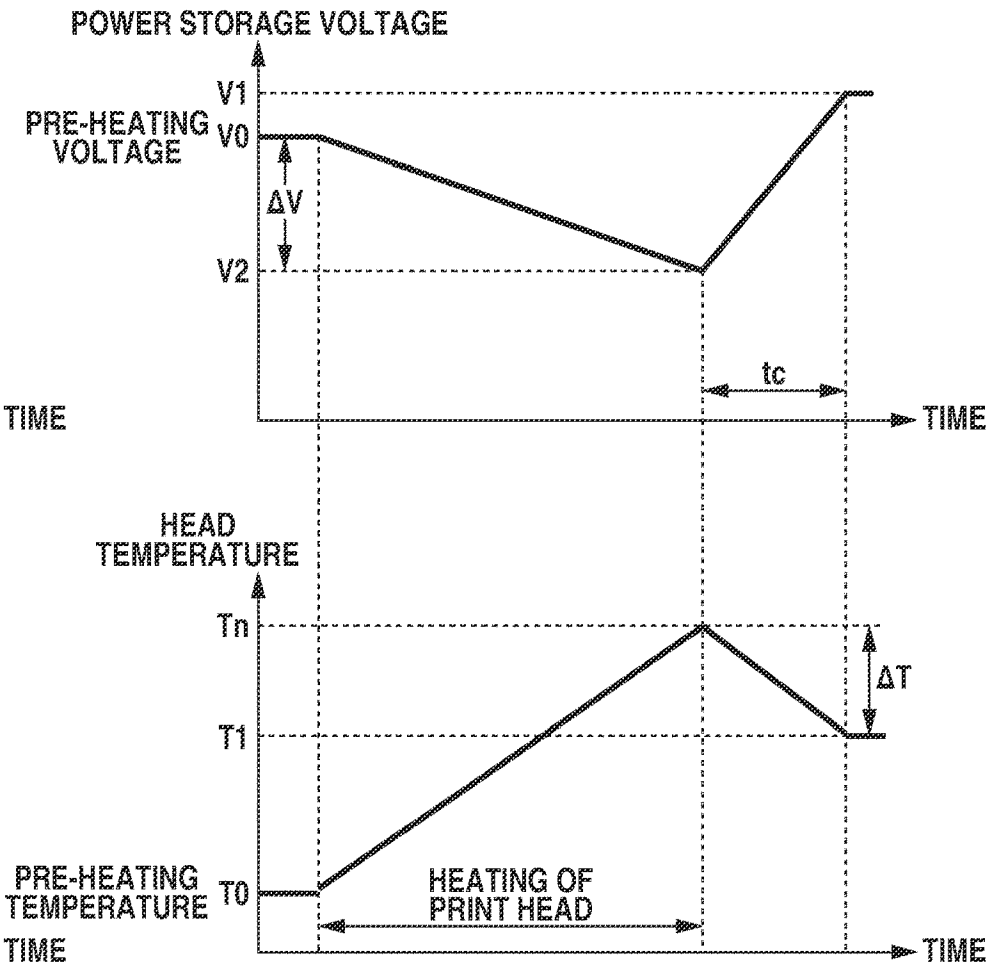

FIGS. 10A and 10B are schematic diagrams each illustrating the head temperature and the voltage across the power storage unit 309 in the first to third exemplary embodiments until the head temperature reaches the set temperature T1 after the heating process is performed. FIG. 10A illustrates a case where the external power supply 301 is an alternating current (AC) adapter or the like and the supplied power P1 is relatively large. FIG. 10B illustrates a case where the external power supply 301 is a USB 2.0 capable device and the supplied power P1 is relatively small. In FIGS. 10A and 10B, the target temperature Tn is the maximum set temperature Tmin or lower, and the post-heating power storage voltage V2 is Vmin or less. In the case of FIG. 10A, the supplied power P1 is large. Therefore, a voltage drop in the power storage unit 309 when the print head is heated is small and the power charging control unit 308 stores power in the power storage unit 309 at a high speed after the heating. As a result, the power storage time tc is short and the target temperature correction value ΔT is small. In contrast, in the case of FIG. 10B, the supplied power P1 is small. Therefore, a voltage drop in the power storage unit 309 when the print head is heated is large and the power charging control unit 308 stores power in the power storage unit 309 at a low speed after the heating. As a result, the power storage time tc is long and the target temperature correction value ΔT is large. Accordingly, the target temperature Tn is higher than in a case where the supplied power P1 is larger. With the target temperature Tn thus set in accordance with the supplied power P1, provided that Tn is Tmax or less and that V2 is Vmin or more, the head temperature Th can be heated to a temperature of T1 or higher, which is suitable for ink discharge, when ink-discharge operation is started. This heating is achievable without print head 107 or 108 heated again and regardless of how large or small the supplied power P1.

In the first to third exemplary embodiments, the operation to be performed after the heating process is ink discharge operation. However, the present exemplary embodiments are not limited to the configuration. For example, since the viscosity of ink decreases as the temperature of the ink is raised, when the discharge port surfaces are wiped using a wiping blade with the ink being in that state, the ink that adheres to the discharge port surfaces returns into the discharge ports or becomes easier to wipe off.

OTHER EMBODIMENTS

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

According to exemplary embodiments of the present disclosure, a target temperature based on supplied power is set, and heating is performed. Thus, at the start of operation to be performed after a print head is heated, ink has a temperature that is suitable for the operation.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-184615, filed Sep. 28, 2018, which is hereby incorporated by reference herein in its entirety.

What is claimed is:

1. A printing apparatus comprising;

a print head including an ink discharge port and a heating element for heating the print head to heat ink contained in the print head;

a power storage unit configured to store, in the power storage unit, electric charge supplied from an external power supply;

a power detection unit configured to detect power supplied from the external power supply;

a temperature detection unit configured to detect a temperature of the print head;

a heating control unit configured to control, as heating control, heating of the heating element to heat the print head by driving the heating element using electric charge stored in the power storage unit, based on a detection result by the temperature detection unit;

an execution unit configured to execute a predetermined operation using the print head and using electric charge stored in the power storage unit after the heating control is completed; and a temperature determination unit configured to determine a target temperature in accordance with the supplied power detected by the power detection unit and with a set predetermined temperature, wherein the target temperature is a temperature to which the heating element is driven to heat the print head in the heating control to bring the detected temperature of the print head to the set predetermined temperature or higher when the predetermined operation starts.

2. The printing apparatus according to claim 1, further comprising a time determination unit configured to determine an amount of time, starting from when the heating control is completed, for storing, in the power storage unit, electric charge to be used in the predetermined operation from the external power supply based on supplied power detected by the power detection unit, wherein the temperature determination unit determines the target temperature based on the amount of time determined by the time determination unit.

3. The printing apparatus according to claim 2, further comprising a stored-power amount detection unit configured to detect an amount of power stored in the power storage unit, wherein the time determination unit determines the amount of time based on the amount of stored power that has been detected by the stored-power amount detection unit.

4. The printing apparatus according to claim 3, wherein the temperature determination unit determines the target temperature based on the amount of stored power detected by the stored-power amount detection unit.

5. The printing apparatus according to claim 3, further comprising a calculation unit configured to calculate an amount of power to be stored in the power storage unit when the heating control is completed, wherein the temperature determination unit determines the target temperature as a first temperature, wherein, based on the amount of stored power detected by the stored-power amount detection unit and on the supplied power detected by the power detection unit, the calculation unit calculates an amount of stored power remaining in the power storage unit after the heating control unit heats the print head to the first temperature, wherein, based on the calculated amount of stored power when the heating control is completed and on the supplied power detected by the power detection unit, the time determination unit determines the amount of time, and wherein, the temperature determination unit determines the first temperature as the target temperature in a case where a temperature, of the print head when the predetermined operation starts, obtained based on the amount of time determined by the time determination unit is the set predetermined temperature or higher, and the temperature determination unit determines a temperature higher than the first temperature as the target temperature in a case where the detected temperature of the print head is lower than the set predetermined temperature.

6. The printing apparatus according to claim 1, wherein, when the predetermined temperature is set based on a maximum temperature of the print head and a temperature, higher than the predetermined temperature, has been found as the target temperature, the temperature determination unit determines the predetermined temperature as the target temperature.

7. The printing apparatus according to claim 1, wherein the predetermined operation that is executed using electric charge stored in the power storage unit after the heating control is completed is an operation for discharging ink from the ink discharge port in the print head.

8. The printing apparatus according to claim 1, wherein the heating control unit heats the print head while power is supplied from the external power supply to the power storage unit.

9. A method for a printing apparatus having a print head having an ink discharge port and a heating element for heating the print head to heat ink contained in the print head, the method comprising:

storing electric charge supplied from an external power supply;

detecting power supplied from the external power supply;

detecting a temperature of the print head;

controlling, as heating control, heating of the heating element to heat the print head by driving the heating element using electric charge, based on a result of detecting the temperature of the print head;

executing a predetermined operation using the print head and using stored electric charge after the heating control is completed; and determining a target temperature in accordance with the detected supplied power and with a set predetermined temperature, wherein the target temperature is a temperature to which the heating element is driven to heat the print head in the heating control to bring the detected temperature of the print head to the set predetermined temperature or higher when the predetermined operation starts.

10. The method according to claim 9, further comprising determining an amount of time, starting from when the heating control is completed, for storing, in the power storage unit, electric charge to be used in the predetermined operation from the external power supply based on detected supplied power, wherein determining the target temperature is based on the determined amount of time.

11. The method according to claim 10, further comprising detecting an amount of stored power, wherein determining the amount of time is based on the amount of stored power that has been detected.

12. The method according to claim 11, wherein determining the target temperature is based on the detected amount of stored power.

13. A non-transitory computer-readable storage medium storing a program to cause a computer to perform a method for a printing apparatus having a print head having an ink discharge port and a heating element for heating the print head to heat ink contained in the print head, the method comprising:

storing electric charge supplied from an external power supply;

detecting power supplied from the external power supply;

detecting a temperature of the print head;

controlling, as heating control, heating of the heating element to heat the print head by driving the heating element using stored electric charge, based on a result of detecting the temperature of the print head;

executing a predetermined operation using the print head and using stored electric charge after the heating control is completed; and determining a target temperature in accordance with the detected supplied power and with a set predetermined temperature, wherein the target temperature is a temperature to which the heating element is driven to heat the print head in the heating control to bring the detected temperature of the print head to the set predetermined temperature or higher when the predetermined operation starts.

* * * * *